US008132569B2

(12) United States Patent
Akerman

(10) Patent No.: US 8,132,569 B2
(45) Date of Patent: Mar. 13, 2012

(54) BRUSH WITH DETACHABLE HANDLE FOR HAIRDRESSING SALON

(76) Inventor: Jean Akerman, Paris (FR)

( * ) Notice: Subject to any disclaimer, the term of this patent is extended or adjusted under 35 U.S.C. 154(b) by 300 days.

(21) Appl. No.: 12/298,489

(22) PCT Filed: Apr. 24, 2007

(86) PCT No.: PCT/FR2007/000687

§ 371 (c)(1),
(2), (4) Date: May 4, 2009

(87) PCT Pub. No.: WO2007/125190

PCT Pub. Date: Nov. 8, 2007

(65) Prior Publication Data

US 2009/0217935 A1 Sep. 3, 2009

(30) Foreign Application Priority Data

Apr. 25, 2006 (FR) ..... 06 51456

(51) Int. Cl.
*A45D 24/16* (2006.01)
*A45D 24/00* (2006.01)

(52) U.S. Cl. ..... 132/120; 132/150

(58) Field of Classification Search ..... 132/120, 132/122, 150; 15/145, 176.1, 176.3, 176.6, 15/202

See application file for complete search history.

(56) References Cited

U.S. PATENT DOCUMENTS 5,887,600 A 3/1999 Wilk
6,070,597 A * 6/2000 Motherhead ..... 132/262

FOREIGN PATENT DOCUMENTS

| | | |
|---|---|---|
| BE | 1007655 A | 10/1995 |
| DE | 9416340 U1 | 12/1994 |
| DE | 29719921 U1 | 2/1998 |
| JP | 7327726 | 12/1995 |
| NL | C2 1 023 465 | 8/2004 |

OTHER PUBLICATIONS

English abstract of BE1007655A.
English abstract of NL C2 1 023 465.
English abstract of JP7327726.
English abstract of DE29719921 U1.

* cited by examiner

*Primary Examiner* — Rachel Steitz
(74) *Attorney, Agent, or Firm* — Donald J. Ersler

(57) ABSTRACT

A hair brush having a brush handle equipped with an assembly end piece (1) at its end and by at least one detachable brush head (2) able to be attached to the assembly end piece (1). The brush head (2) is constituted by a hair-bearing rod (7) inserted into the inner part of an essentially rigid perforated tubular sleeve (8) and the assembly end piece (1) is equipped with at least one annular groove (4) that is at least 5 mm deep, and preferably about 15 mm deep and a diameter matching that of the tubular sleeve (8) whereof it is intended to receive one of the ends (12) or male end.

12 Claims, 3 Drawing Sheets

BRUSH WITH DETACHABLE HANDLE FOR HAIRDRESSING SALON

A "brushing" is a technique for drying and shaping a hairstyle that is well known to hairdressers ("brushing"), and which usually requires the action of combining the use of a hair dryer and an essentially cylindrical hairbrush.

From this basic technique, if the hairdresser wishes to create volume, or to curl a head of hair, he or she must re-pick-up each warm streak of hair previously set in shape on a curler until the streaks cool down in order to obtain a new shape corresponding to the diameter of the curler. Such a process requires the hairdresser to put down and pick up the hair dryer incessantly to be able to re-wrap successively the hot streaks of hair on another curler. It is long and tiresome work requiring around 45 seconds per curler, which per head, is a loss of time of 10 to 15 minutes for 14 curlers.

The present invention proposes a hairbrush with a removable handle to remedy this inconvenience. According to one embodiment the present invention provides a hairbrush with a removable handle for the purpose of proceeding with a hair arranging technique involving blow drying. Such a hairbrush consists of a handle of a hairbrush equipped with an assembly end cap at its extremity connected to at least one detachable brush head.

According to this invention, the head of the brush from such a hairbrush has a bristled rod inserted into the inner part of an essentially rigid perforated tubular sleeve. The assembly end cap of the brush handle is equipped with at least one annular groove with a depth of at least 5 mm and preferably 15 mm, and a diameter corresponding to the tubular sleeves which it is designed to accommodate at the ends or the male end.

Such a brush allows the hairdresser to make a "brushing" in the usual way but the head of the brush can become a curler susceptible to keeping the warm streak of hair wrapped around it until it cools down by removing the handle of the brush. Separating the head of the brush from the handle permits freeing the handle and attaching it to another brush head which will again become a curler.

According to a preferred embodiment of the invention, the assembly end cap includes at least one shoulder (junction) extended by an annular groove in its inner part delimited by its external cylindrical segment having a diameter corresponding to the round sleeve.

It should be noted that in the framework of this description the terms "internal" and "external" or "inside" and "outside" must be interpreted considering the brush from the direction of the handle toward the free extremity of the head of the brush.

When setting in place the head of the brush on the assembly end cap, the cylindrical segment enters into the internal part of the perforated tubular sleeve, which allows the head of the brush to be secured and maintained. It is of course necessary for that purpose, as the bristled rod does not have bristles at this level.

To allow the hairdresser to use the hairbrush with satisfaction the removable handle conforms to the invention, it is essential that the assembly end cap be equipped with a device blocking the head of the brush in rotation. This blocking device can have different configurations without going outside the framework of the invention. For example, they can be constituted from at least three forks extending the assembly end cap toward the outside which allows to penetrate in the internal part of the tubular sleeve equipped with the bristled rod. Accordingly, the tubular sleeve can be constituted by an element, for example a metallic one, equipped to facilitate the manufacturing of a longitudinal slit. In this case, the cylindrical segment of the assembly end cap can have a diameter slightly greater than the diameter of the tubular sleeve which allows to maintain this element with more pressure, the slit acting as a pressure regulator.

Moreover, the groove which accommodates the assembly end cap can favourably be equipped on the inside part with a protruding pin adapted to grip the longitudinal slit which constitutes the device blocking the head of the brush in rotation.

Accordingly, when the hairdresser inserts the male extremity of the tubular sleeve in the annular groove, the hairdresser must at the same time impart a rotational movement until the longitudinal slit reaches the level of the pin and opens under the effort of elasticity in such a way that the head of the brush clicks and is blocked by this pin.

According to another characteristic of the invention the assembly end cap is equipped with a median longitudinal hole designed to accommodate the male extremity of the bristled rod without bristles at this level. Such a hole allows guiding and blocking of the head of the brush when set on the assembly end cap.

One can also eventually equip the male extremity of the bristled rod with a strip, namely a conical strip defining a self-blocking system when introduced in the hole of the assembly end cap to stop the rotation of the brush head.

In accordance with one preferred embodiment of the invention the handle of the brush consists of a hot air blowing device and the assembly end cap is equipped with a longitudinal opening, which allows the hot air to go through. According to this variation of the invention the handle of the brush is also a hand dryer, which facilitates the work of the hairdresser.

The assembly end cap can also be attached to such an air-blowing handle by any means without going out from the framework of the invention (i.e. by screws, others devices, or systems or pins). According the invention, the handle of the brush is attached to a series of removable heads of the brush whose tubular sleeves have at least two or three sizes in diameter (big, medium, small). Such a hairbrush is universal and can be used with tubular sleeves of different diameters according the form and shape desired.

In accordance with this variation the assembly end cap consists of a pyramid shaped element and each level, with the exception of the internal one, consists of cylindrical segments having a diameter corresponding to the diameter of the tubular sleeve. Each of theses cylindrical segments are surrounded by an annular groove destined to accommodate the male extremity of the sleeve.

The hairdresser can thus choose as he wishes depending on the desired effect, the diameter of the sleeve to be set on the handle of the brush.

The characteristics of the hairbrush with a removable handle which is an object of this invention, are described in more detail in the annexed drawings but are not limited therein:

Figure 1:
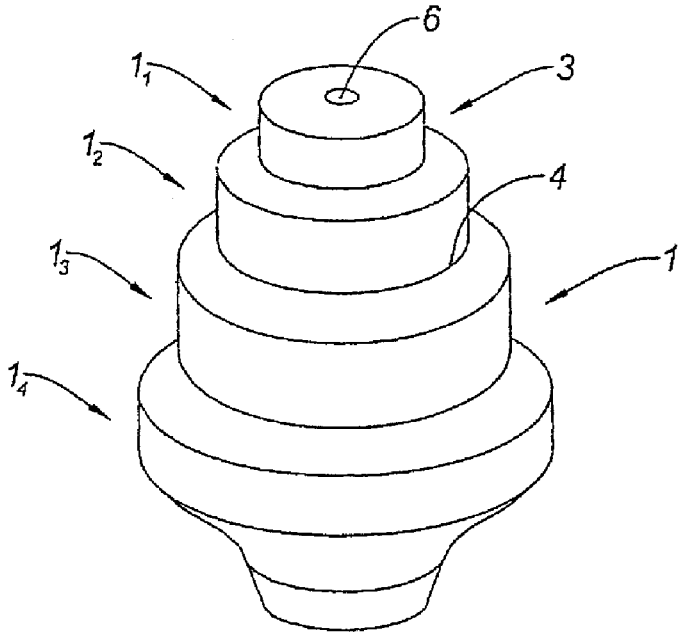
FIG. 1 is a perspective view in a greater scale of the assembly end cap.
Figure 2:
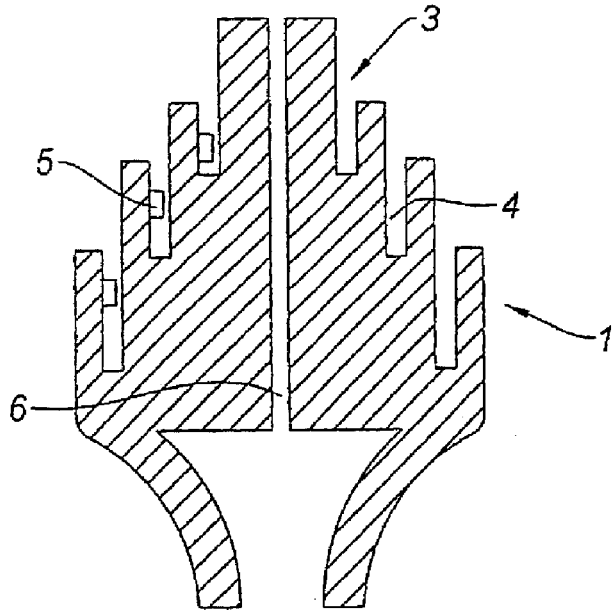
FIG. 2 is a longitudinal cut of a the assembly end cap represented in FIG. 1.
Figure 3:
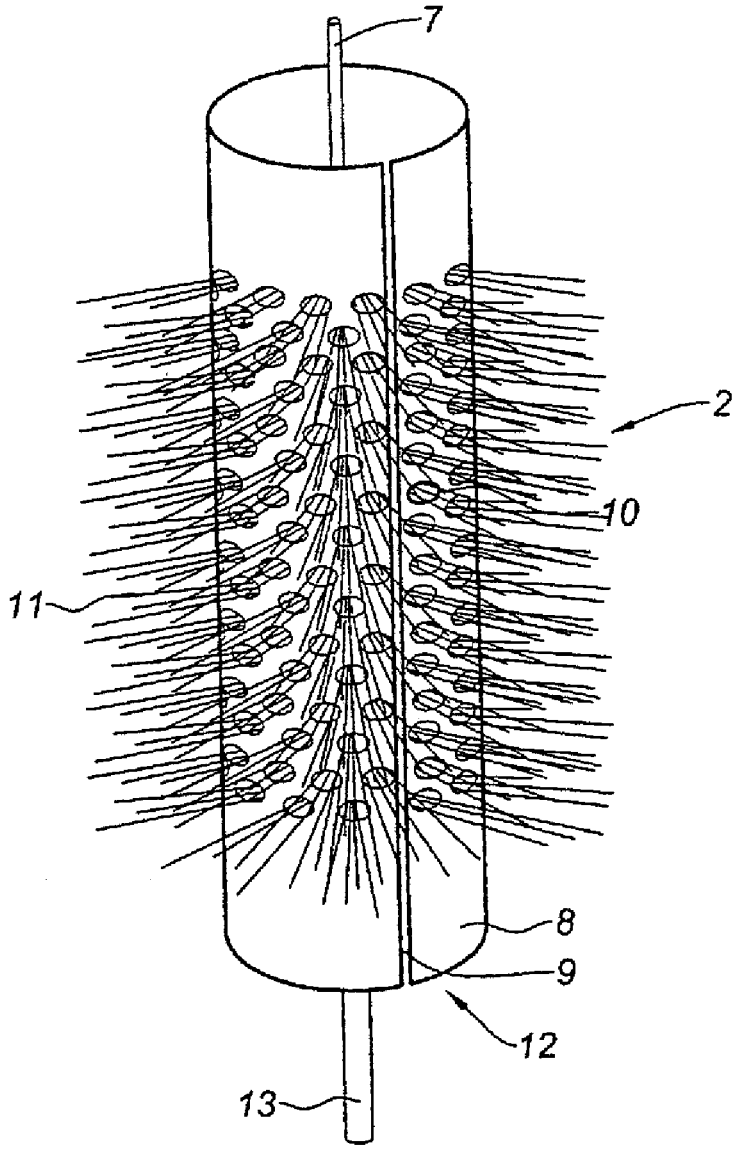
FIG. 3 is a perspective view of the head of the brush.
Figure 4:
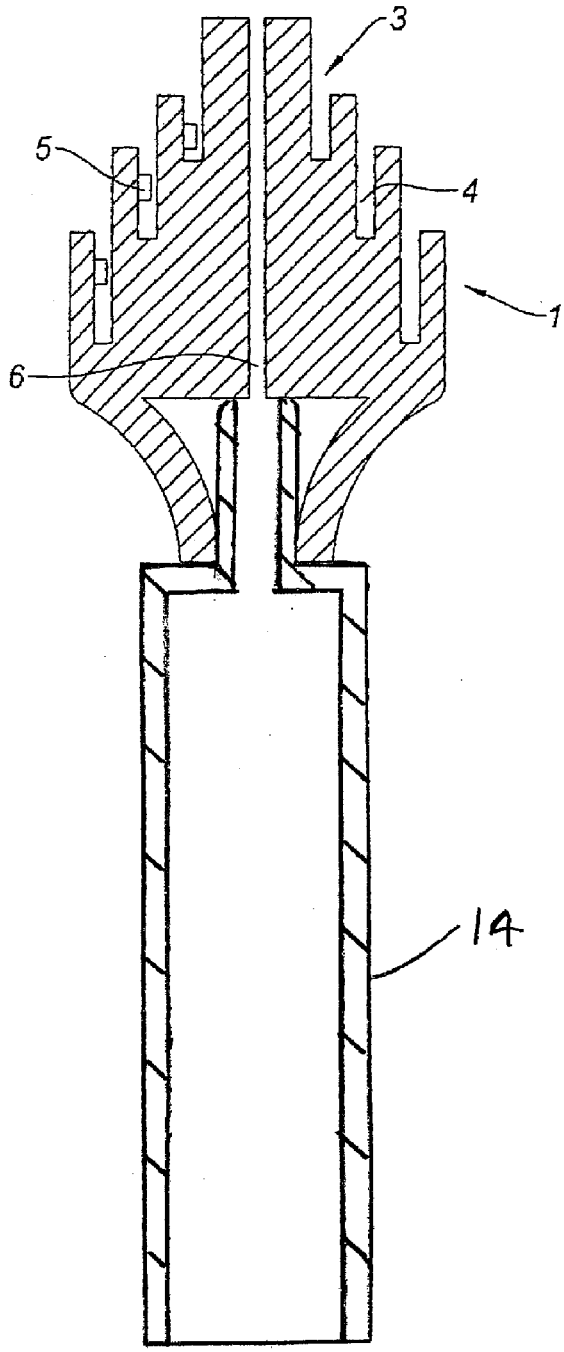
FIG. 4 is a cross-sectional view of a handle extending from an assembly end cap.

According to the figures, the hairbrush with the removable handle consists of the attachment of a hairbrush handle 14 equipped at its extremity with an assembly end cap represented in FIGS. 1 and 2 and a removable head 2 represented in FIG. 3 susceptible to be attached to the assembly end cap 1. The assembly end cap 1 is attached to the handle 14 of the brush by any system or device.

FIGS. 1 and 2 show the assembly end cap 1 as an element in the shape of a pyramid having four levels $\mathbf{1}_1$, $\mathbf{1}_2$, $\mathbf{1}_3$, $\mathbf{1}_4$. The three external levels $\mathbf{1}_1$, $\mathbf{1}_2$, $\mathbf{1}_3$, consist of cylindrical segments declining in diameter going outward and are separated by shoulder 3. As shown in FIG. 2 each shoulder 3 extends toward the inside by a deep annular groove 4. The internal part of annular groove 4 is equipped with a protruding pin 5 having a function which will be further later explained in this description.

The assembly end cap 1 is also equipped with a piercing longitudinal median 6 whose function will also be further explained later in the description. It should be noted that according to a variant of the invention in which the brush handle consists of a hot air blowing device, a longitudinal opening that is not show in the drawing is added to the piercing median 6.

As shown in FIG. 3, the head of the brush 2 consists of bristled rod 7 introduced inside the metallic tubular sleeve 8 including longitudinal slit 9. The tubular sleeve 8 is equipped on the surface with a series of holes 10 which allow the bristles to go thought 11 the equipped bristled rod 7.

In FIGS. 1 to 3 the diameter of each cylindrical segment $\mathbf{1}_1$, $\mathbf{1}_2$, $\mathbf{1}_3$, from the assembly end cap 1 correspond to the diameter of tubular sleeve 8 at one of the extremities or to the male extremity 12 designed to be inserted. The assembly end cap 1 can cooperate with three types of brush heads 2 whose tubular sleeves 8 have different diameters.

Upon insertion, the extremity male 13 of the bristled rod 7 penetrates inside the longitudinal median hole 6 of the assembly end cap while the extremity male 12 of the tubular sleeve 8 penetrates the annular groove 4.

The rotation of the tubular sleeve 8 in the annular groove ring 4 allows to bring the longitudinal slit 9 straight from pin 5 making gripping the annular ring 4 thus creating an opening of the slit due to the elasticity of the tubular sleeve 8 and then introduce the pin in this slit to block the brush head 2 thus blocking its rotation.

The invention claimed is:

1. A hair brush with a detachable handle, comprising:

a bristled rod includes a rod and a plurality of bristles, said plurality of bristles extend radially from around a perimeter surface of said rod;

at least two tubular sleeves, each one of said at least two tubular sleeves having a plurality of openings formed through a perimeter surface thereof, each one of said at least two tubular sleeves having a different perimeter size, said plurality of bristles are inserted through said plurality of openings to form a brush head; and an end cap includes an axial opening and at least two annular grooves, said axial opening is formed in an axis of said end cap, said axial opening is sized to removably receive said rod, said at least two annular grooves are formed substantially concentric with said axial opening, said at least two annular grooves are sized to receive said two at least two tubular sleeves.

2. The hair brush with a detachable handle of claim 1 wherein:

a slit is formed in a bottom of one of said at least two tubular sleeves.

3. The hair brush with a detachable handle of claim 1 wherein:

a slit is formed in a length of one of said at least two tubular sleeves.

4. The hair brush with a detachable handle of claim 1, further comprising:

a pin is inserted into at least one of said at least two annular grooves to prevent rotation of one of said at least two tubular sleeves relative to said end cap.

5. A hair brush with a detachable handle, comprising:

a bristled rod includes a rod and a plurality of bristles, said plurality of bristles extend radially from around a perimeter surface of said rod;

at least one tubular sleeve, each one of said at least one tubular sleeve having a plurality of openings formed through a perimeter surface thereof, said plurality of bristles are inserted through said plurality of openings to form a brush head; and an end cap includes an axial opening and at least two annular grooves, said axial opening is formed in an axis of said end cap, said axial opening is sized to removably receive said rod, said at least two annular grooves are formed substantially concentric with said axial opening, one of said at least two annular grooves are sized to receive one of said at least one tubular sleeve.

6. The hair brush with a detachable handle of claim 5 wherein:

a slit is formed in a bottom of one of said at least one tubular sleeve.

7. The hair brush with a detachable handle of claim 5 wherein:

a slit is formed in a length of one of said at least one tubular sleeve.

8. The hair brush with a detachable handle of claim 5 wherein:

a pin is inserted into at least one of said at least two annular grooves to prevent rotation of one of said at least one tubular sleeve relative to said end cap.

9. A hair brush with a detachable handle, comprising:

a bristled rod includes a rod and a plurality of bristles, said plurality of bristles extend radially from around a perimeter surface of said rod;

at least one tubular sleeve, each one of said at least one tubular sleeve having a plurality of openings formed through a perimeter surface thereof, said plurality of bristles are inserted through said plurality of openings to form a brush head; and an end cap includes a lengthwise axial opening and at least two annular grooves, said lengthwise axial opening is formed in an axis of said end cap, said lengthwise axial opening is sized to removably receive said rod and to allow the flow of air therethrough, said at least two annular grooves are formed substantially concentric with said axial opening, one of said at least one annular groove is sized to receive one of said at least one tubular sleeve.

10. The hair brush with a detachable handle of claim 9 wherein:

a slit is formed in a bottom of one of said at least one tubular sleeve.

11. The hair brush with a detachable handle of claim 9 wherein:

a slit is formed in a length of one of said at least one tubular sleeve.

12. The hair brush with a detachable handle of claim 9, further comprising:

a pin is inserted into at least one of said at least two annular grooves to prevent rotation of one of said at least one tubular sleeve.

* * * * *